US006811587B1

(12) United States Patent
Lorey et al.

(10) Patent No.: US 6,811,587 B1
(45) Date of Patent: Nov. 2, 2004

(54) BIOLOGICAL HAZARD MITIGATION APPARATUS FOR MAIL/PACKAGE HANDLING PERSONNEL SAFETY AND OPERATING METHODS THEREFOR

(75) Inventors: Richard A Lorey, King George, VA (US); Michael A Pompeii, Fredericksburg, VA (US); Dale W Sisson, King George, VA (US); William E. Blakley, II, King George, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/302,325

(22) Filed: Nov. 18, 2002

Related U.S. Application Data

(60) Provisional application No. 60/331,435, filed on Nov. 16, 2001.

(51) Int. Cl.[7] ..... F24F 9/00; F24F 13/06

(52) U.S. Cl. ..... 55/385.2; 55/473; 55/DIG. 18; 55/DIG. 29; 55/DIG. 46; 454/187; 454/190; 454/236; 454/296

(58) Field of Search ..... 55/385.2, 385.1, 55/356, DIG. 18, 471, 472, 473, DIG. 29, DIG. 46; 454/187, 190, 236, 296; 96/384

(56) References Cited

U.S. PATENT DOCUMENTS 3,776,121 A * 12/1973 Truhan ..... 55/DIG. 29
4,333,745 A 6/1982 Zeanwick
4,371,101 A 2/1983 Cane et al.
4,754,655 A 7/1988 Parker et al.
4,880,581 A * 11/1989 Dastoli et al. ..... 55/385.2
5,090,972 A * 2/1992 Eller et al. ..... 55/385.2
5,162,652 A 11/1992 Cohen et al.
5,558,112 A * 9/1996 Strieter ..... 55/DIG. 29
5,585,575 A 12/1996 Corrigan et al.
5,725,426 A * 3/1998 Alvarez ..... 55/385.2
5,807,414 A 9/1998 Schaefer
5,854,431 A 12/1998 Linker et al.
5,984,990 A 11/1999 McDonald
6,085,601 A 7/2000 Linker et al.
6,132,356 A 10/2000 Schabdach et al.
6,233,748 B1 5/2001 Gieger et al.
6,290,740 B1 9/2001 Schaefer
6,321,608 B1 11/2001 Wagner et al.
6,395,047 B1 5/2002 Smith
6,402,613 B1 * 6/2002 Teagle ..... 454/195
6,508,850 B1 * 1/2003 Kotliar ..... 55/385.2
6,576,028 B2 * 6/2003 Santos ..... 55/320
6,616,720 B1 * 9/2003 Smith ..... 55/385.2
6,623,550 B2 * 9/2003 Shah et al. ..... 96/134

* cited by examiner

*Primary Examiner*—Duane Smith
*Assistant Examiner*—Minh-Chau T. Pham
(74) *Attorney, Agent, or Firm*—Matthew J. Busan, Esq.; Marguerite O. Dineen, Esq.

(57) ABSTRACT

A biological hazard mitigation apparatus permitting a material handling operation in the vicinity of a work area includes a plenum pneumatically coupled and proximate to one side of the work area, a filter sized to trap biological hazards and including an exhaust port, a blower including an inlet port and an exhaust port, and ducting pneumatically coupling the exhaust port of the filter to the inlet port of the blower, wherein the filter is disposed in the plenum, and adjacent surfaces of the filter and the plenum are substantially equal in surface area. If desired, the ducting includes first and second ducts, permitting a silencer to be disposed between the first and second ducts. Methods for operating the apparatus are also described.

20 Claims, 21 Drawing Sheets

FIG. 2A
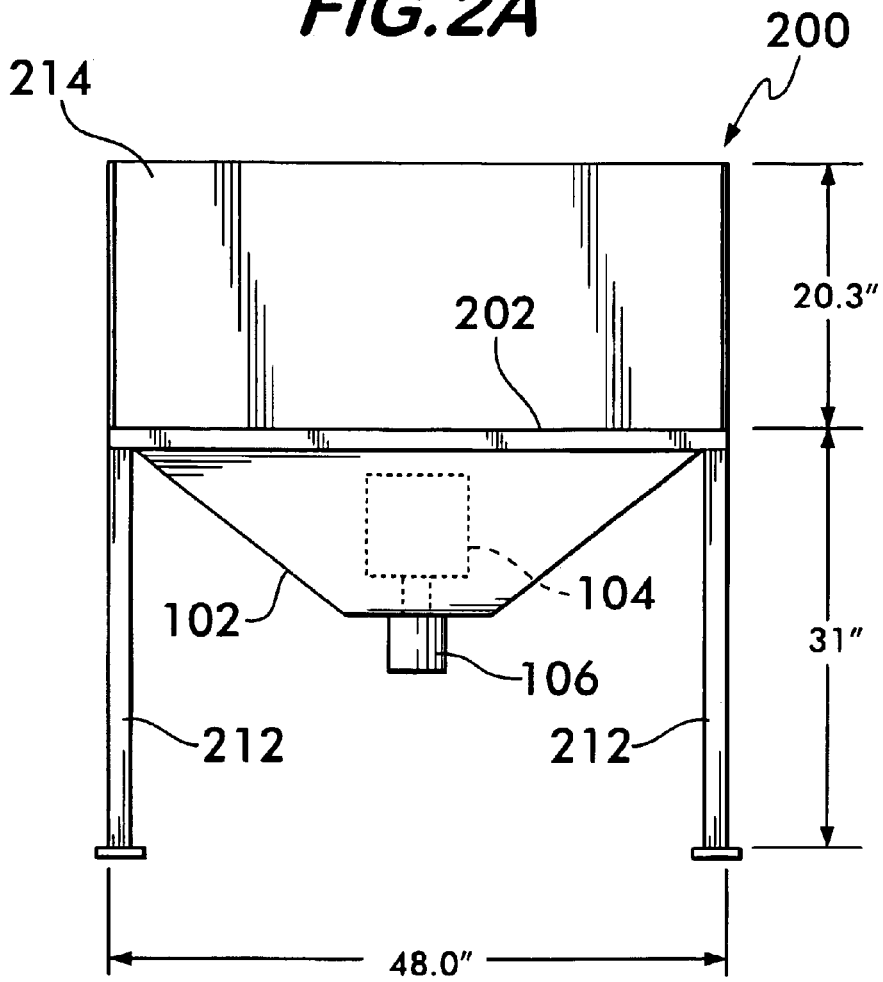
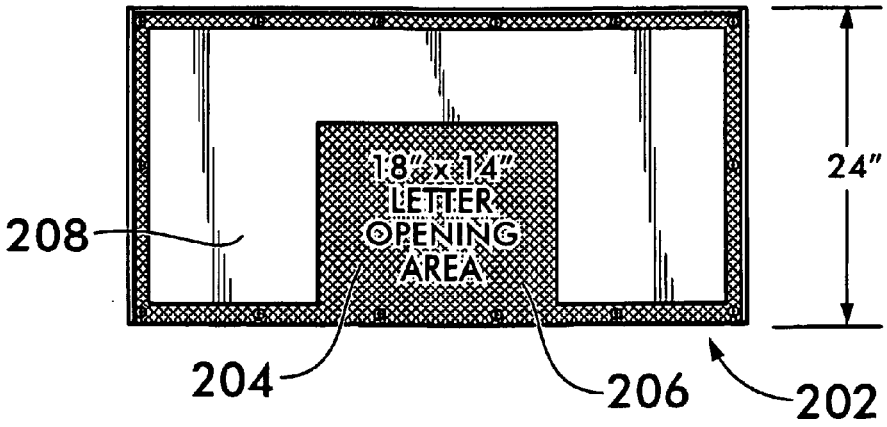
FIG. 2B 1. 128FPM
2. 122
3. 141
4. 125
5. 121
6. 122
7. 120
8. 126
9. 116

1. 225
2. 223
3. 228
4. 248
5. 185
6. 185
7. 197
8. 220
9. 256

BIOLOGICAL HAZARD MITIGATION APPARATUS FOR MAIL/PACKAGE HANDLING PERSONNEL SAFETY AND OPERATING METHODS THEREFOR

CROSS-REFERENCE TO RELATED APPLICATIONS

This patent application claims the benefit of priority, under 35 U.S.C. §119(e), of Provisional Patent Application No. 60/331,435, which was filed on Nov. 16, 2001, and which is incorporated, in its entirety, herein by reference.

STATEMENT OF GOVERNMENT INTEREST

The invention described herein was made in the performance of official duties by employees of the Department of the Navy and, thus, the invention disclosed herein may be manufactured, used, licensed by or for the Government for governmental purposes without the payment of any royalties thereon.

BACKGROUND OF THE INVENTION

The present invention relates generally to mail and/or package handling systems. More specifically, the present invention relates to mail and/or package handling systems for environments where biological hazards may be present. Corresponding methods and protocols for mitigating the biological hazard are also disclosed.

Many organizations, e.g., various branches and departments of government and family planning clinics, have long operated under the threat of receiving one of several biologically hazardous materials. Since September 2001, the entire country has become aware of biologically hazardous material being delivered via the U.S. Postal Service. The entire world now knows that anthrax spores can be delivered in this manner. Other, commercial shipping services may also become the delivery mechanism for biologically hazardous materials.

Systems exist for destroying biologically hazardous material. For example, microwave and gamma radiation sterilization systems are available from various sources. However, such equipment is prohibitively expensive for facilities handling a few hundred letters/packages per day. Until regional sterilization facilities can be built, personnel may encounter biological hazards in delivered mail and packages. Since the most serious risk to personnel in the most often encountered biological hazards is through inhalation, what is needed is an apparatus, which permits personnel to perform routine mail handling tasks while minimizing the risk of inhaling or ingesting biologically hazardous material.

One potential mechanism for preventing the spread of biological hazard escaping from received letters/packages is to employ a vacuum device, e.g., a shop vac, in the central mail handling area. This proposed solution creates the following problems:

1. The spores associated with biological hazards such as anthrax are small. One of the periods appearing on this page could accommodate thousands of such spores. The air handling systems for most conventional vacuum systems are not sized to capture such spores; the spores are exhausted from the vacuum system. Thus, the exhaust of the conventional vacuum system promotes, rather than suppresses, airborne spores.
2. Vacuums equipped with high efficiency filters such as HEPA filters and Ultra filters are generally capable of removing airborne spores. However, HEPA equipped vacuums locate the HEPA filters downstream of the blower in the vacuum system. In that case, while the HEPA will prevent or at least minimize the exhausting of particulate biologically hazardous material, it does so at the expense of contaminating all upstream components in the vacuum system.
3. Vacuum systems, with or without HEPA filters, are generally noisy. While ear protection devices can be employed, such devices generally interfere with the other duties that mail-handling personnel are often asked to perform.

Many systems of implementing the vacuum system concept discussed in general terms above are known. For example, U.S. Pat. Nos. 5,807,414 and 6,290,740, both of Schaefer, disclose worktables for the performance of welding and grinding procedures. Each of the apparatuses disclosed includes a large work surface formed from a plurality of panels, each panel having a high number of perforations, which permit a high flow rate at a relatively low noise level. A fan is pneumatically coupled to the rear of the workbench. The fan discharges to one of a discharge filter housing enclosing a pre-filter and a final filter or a dust collector. In contrast, U.S. Pat. No. 5,984,990 to McDonald discloses a worktable for machining operations producing fiber particles or residue. Air flows through a number of grates, each equipped with a damper for controlling airflow, and is collected in a plenum discharging to a filter stack. A fan is disposed downstream of the filter stack to provide a negative pressure at the outlet of the filter stack; the fan discharges to the workspace where the work table is located.

In addition, there are myriad ways to sample a potentially hazardous area stream, such as those generated by the vacuum systems mentioned immediately above. For example, U.S. Pat. No. 4,754,655 to Parker, III et al. discloses an apparatus and method for sampling hazardous material. The apparatus comprises a conical shroud (plenum); a sampling nozzle; a filter; extension tube; a vacuum hose and a vacuum device. The sampling nozzle that is operatively coupled to the vacuum device forextracting a sample of the material from goods suspected of being hazardous. An optional HEPA filter is disposed downstream of and separate from the sampling nozzle.

There are also several mechanisms by which potentially hazardous materials can be sampled for identification. For example, U.S. Pat. Nos. 5,854,431 and 6,085,601, both to Linker et al., disclose a particle pre-concentrator apparatus which permits detection of highly diluted amounts of airborne targeted substances, such as explosives, narcotics or chemical agents. The apparatus comprises a filter for filtering particles in a main gas stream, such as a stream of ambient air and carry them to a particle detector, such as an ion mobility spectrometer. The apparatus further comprises a fan for inducing the movement in the air stream.

SUMMARY OF THE INVENTION

Based on the above and foregoing, it can be appreciated that there presently exists a need in the art for a biological hazard mitigation apparatus which overcomes the above-described deficiencies. The present invention was motivated by a desire to overcome the drawbacks and shortcomings of the presently available technology, and thereby fulfill this need in the art.

In one aspect, the present invention provides a biological hazard mitigation apparatus permitting a material handling operation in the vicinity of a work area, including a plenum pneumatically coupled and proximate to one side of the work area, a filter sized to trap biological hazards and including an exhaust port, a blower including an inlet port and an exhaust port, and ducting pneumatically coupling the exhaust port of the filter to the inlet port of the blower, wherein the filter is disposed in the plenum, and adjacent surfaces of the filter and the plenum are substantially equal in surface area. If desired, the ducting includes first and second ducts, permitting a silencer to be disposed between the first and second ducts. In an exemplary case, the filter includes a polishing filter disposed downstream of a roughing filter. The roughing filter can be a bag filter while the polishing filter can be a pleated paper filter. Alternatively, the filter can be a HEPA filter.

The biological hazard mitigation apparatus advantageously can include a plurality of legs, and a work surface supported by the legs, the work surface including an upper surface and a lower surface. If desired, the work area includes a portion of the work surface having air passages therein to permit airflow between the upper surface and the lower surface, and the plenum is operatively coupled to the lower surface of the work surface adjacent to the work area. In an exemplary case, the filter is accessed via the work area. In another exemplary case, the filter and the blower are disposed on opposite sides of a wall. The wall may be the exterior wall of a building and, thus, the exhaust port of the blower discharges to the environment.

In another aspect, the present invention provides a method for operating a biological hazard mitigation apparatus permitting a material handling operation in the vicinity of a work area, the apparatus including a plenum pneumatically coupled and proximate to one side of the work area, a filter sized to trap biological hazards and including an exhaust port, a blower including an inlet port and an exhaust port, and ducting pneumatically coupling the exhaust port of the filter to the inlet port of the blower, wherein the filter is disposed in the plenum, and adjacent surfaces of the filter and the plenum are substantially equal in surface area. The method includes steps for processing each piece of received material proximate to the work area to thereby generate processed material, isolating the processed material, analyzing the filter for biological hazards, further processing the processed material when biological hazards are not present, and decontaminating the processed material when biological hazards are present. When the filter includes a polishing filter disposed downstream of a roughing filter, the analyzing step is performed on the roughing filter. When the filter includes a HEPA filter, the analyzing step is performed on the upstream surface of the HEPA filter.

In a further aspect, the present invention provides a method for operating a biological hazard mitigation apparatus permitting a mail handling operation in the vicinity of a work area, the apparatus including a plenum pneumatically coupled and proximate to one side of the work area, a filter sized to trap biological hazards and including an exhaust port, a blower including an inlet port and an exhaust port, and ducting pneumatically coupling the exhaust port of the filter to the inlet port of the blower, wherein the filter is disposed in the plenum, including steps for processing each piece of received mail proximate to the work area to thereby generate processed mail and packaging, isolating the processed mail and the packaging from both the apparatus and one another, analyzing at least one of the filter and the packaging for biological hazards, distributing the processed when biological hazards are not present, and decontaminating and then distributing the processed mail when biological hazards are present. When the filter includes a polishing filter disposed downstream of a roughing filter, the analyzing step is performed on the roughing filter. When the filter includes a HEPA filter, the analyzing step can be performed on the upstream surface of the HEPA filter.

BRIEF DESCRIPTION OF THE DRAWINGS

These and various other features and aspects of the present invention will be readily understood with reference to the following detailed description taken in conjunction with the accompanying drawings, in which like or similar numbers are used throughout, and in which:

FIGS. 2A, 2B, and 2C are front, top, and perspective views, respectively, of a second preferred embodiment of the biological hazard mitigation apparatus according to the present invention while

FIGS. 4A, 4B, 4C, and 4D are front and top views, in alternative-forms, respectively, of a third preferred embodiment of the biological hazard mitigation apparatus according to the present invention while

DETAILED DESCRIPTION OF THE PREFERRED EMBODIMENTS

Figure 1:
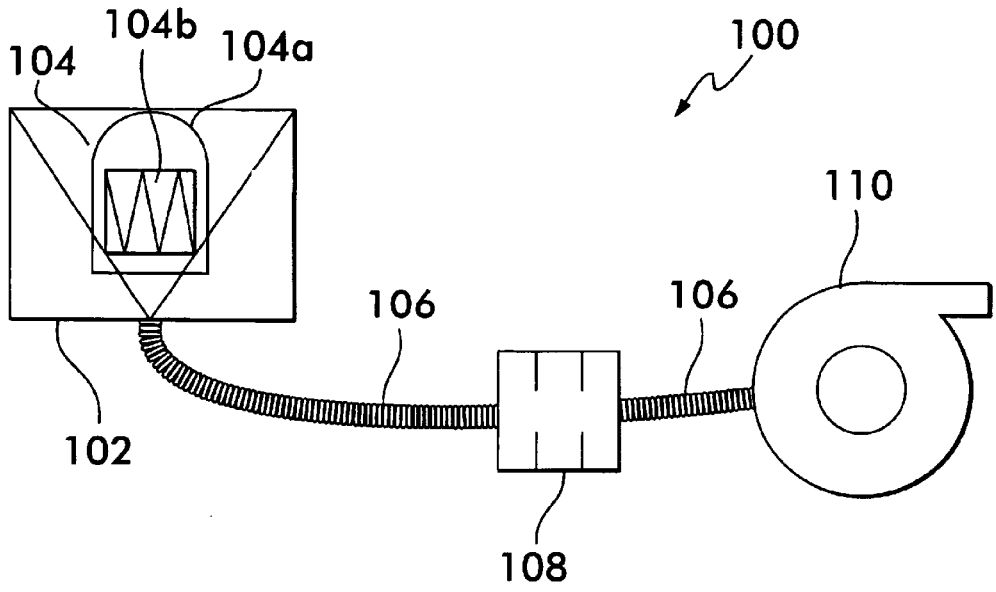
FIG. 1 is a schematic diagram of one preferred embodiment of a biological hazard mitigation apparatus according to the present invention.
Figure 3A:
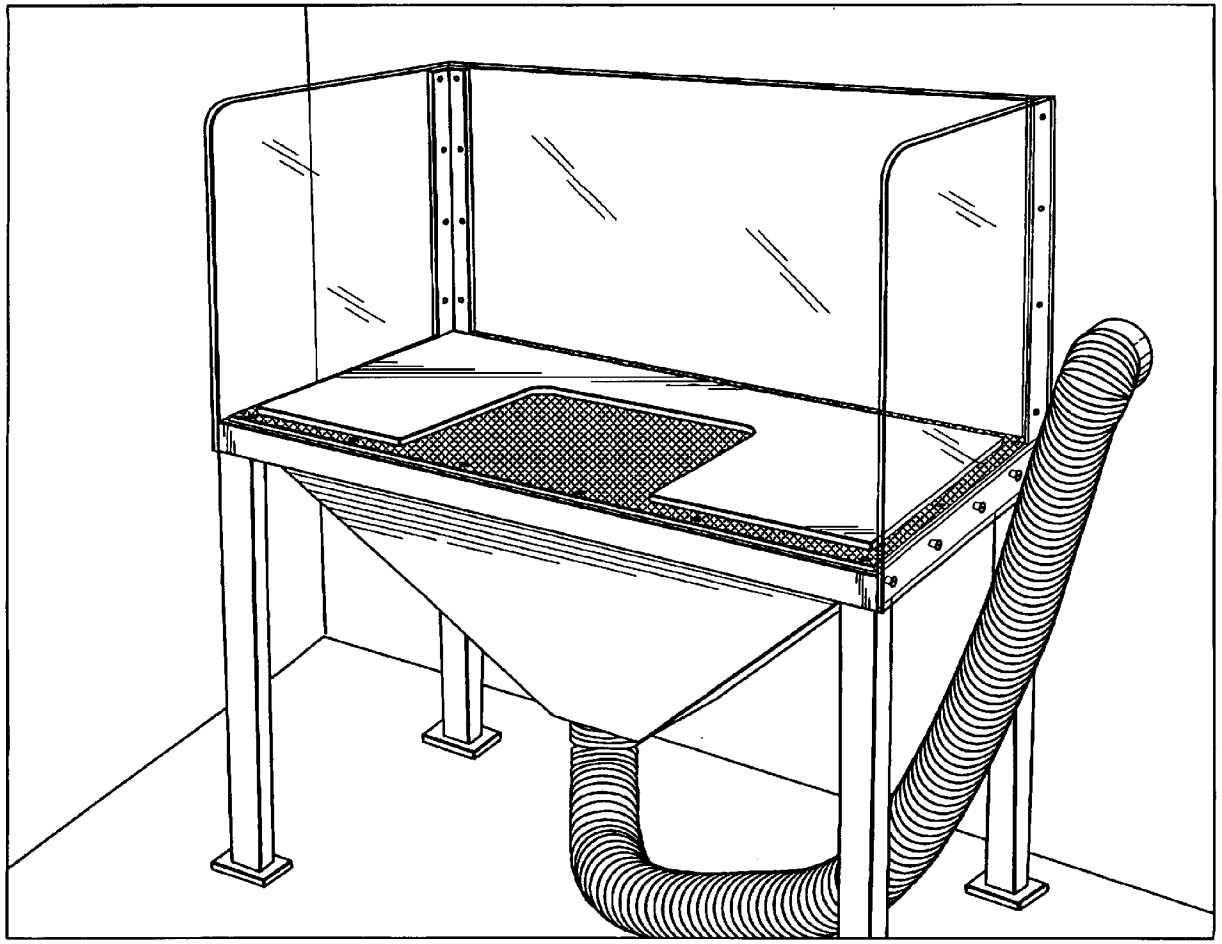
FIGS. 3A, 3B, 3C, and 3D are photographs of an actual device constructed in accordance with the second preferred embodiment depicted in FIGS. 2A-2C.
Figure 3B:
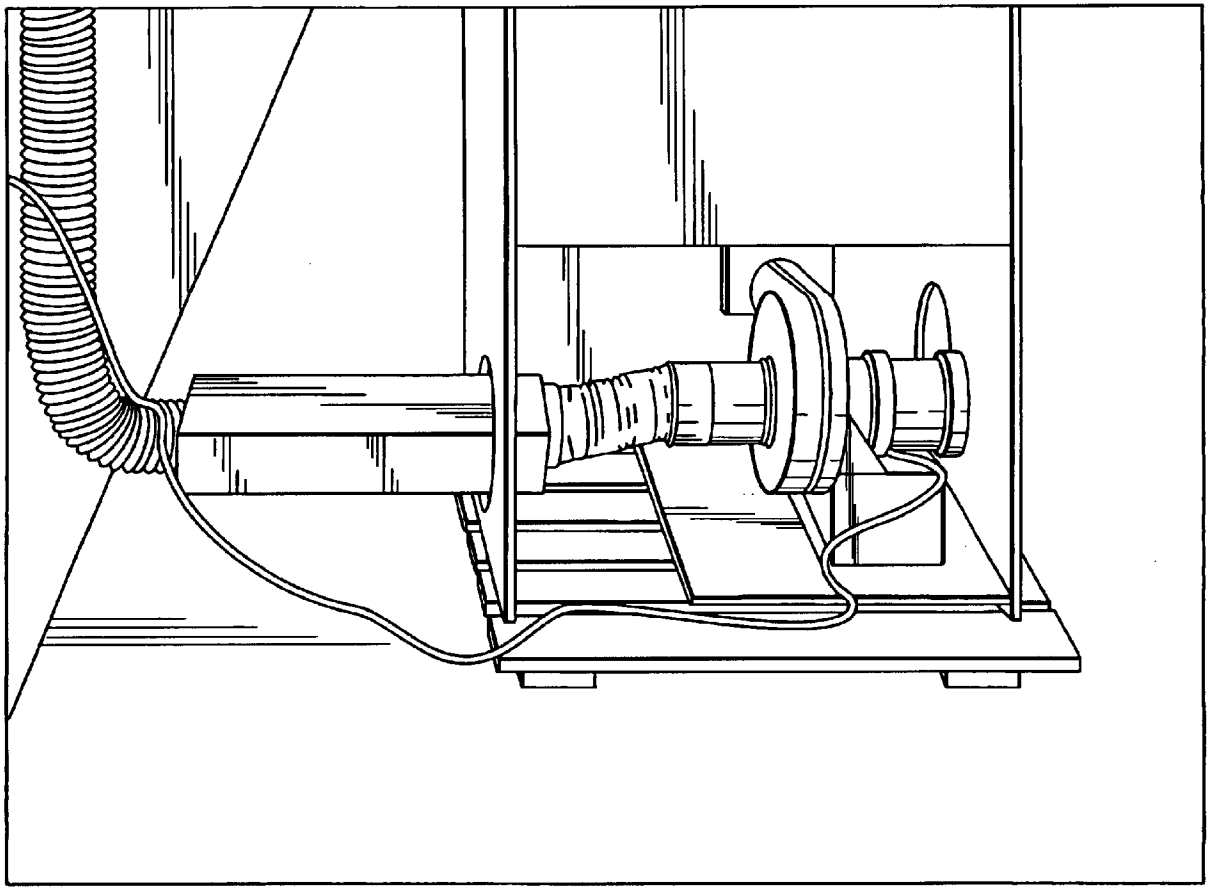
Figure 3C:
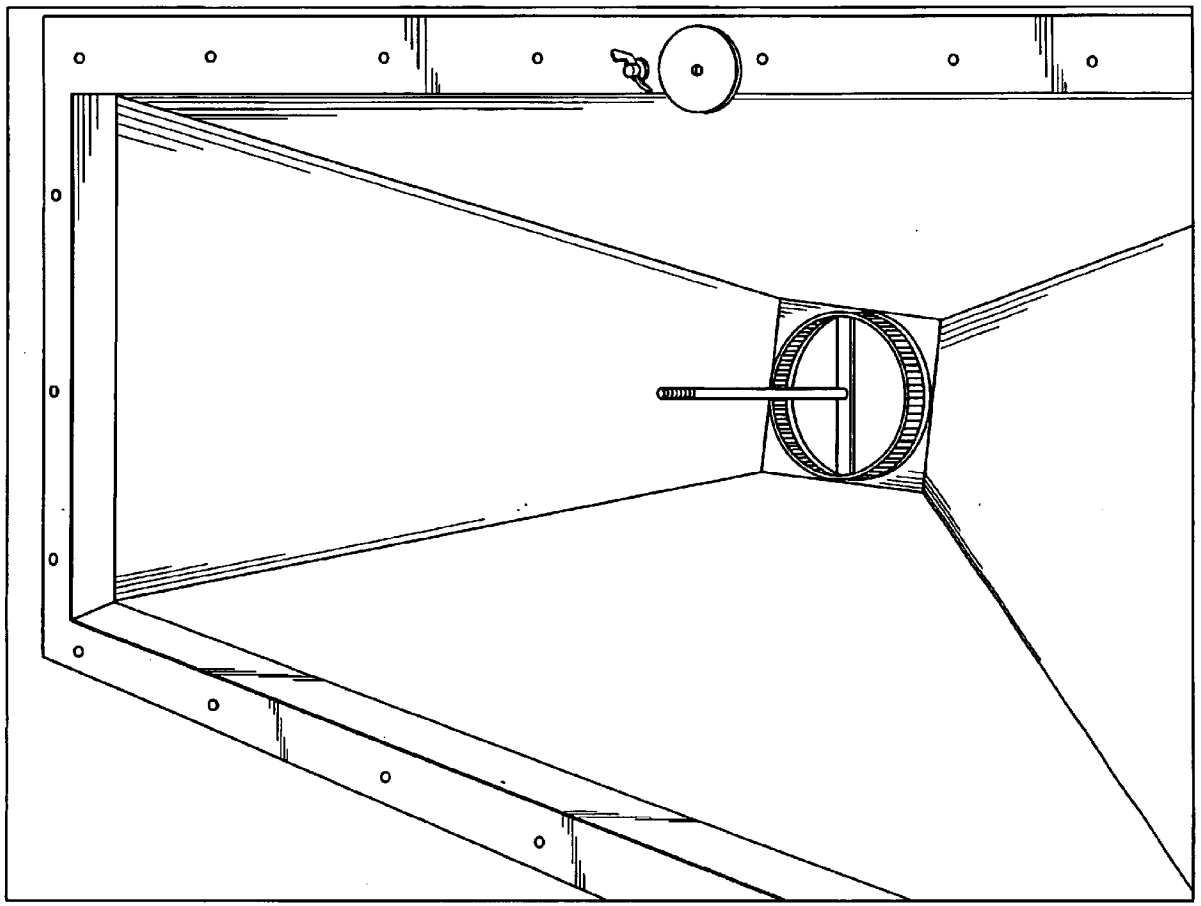
Figure 3D:
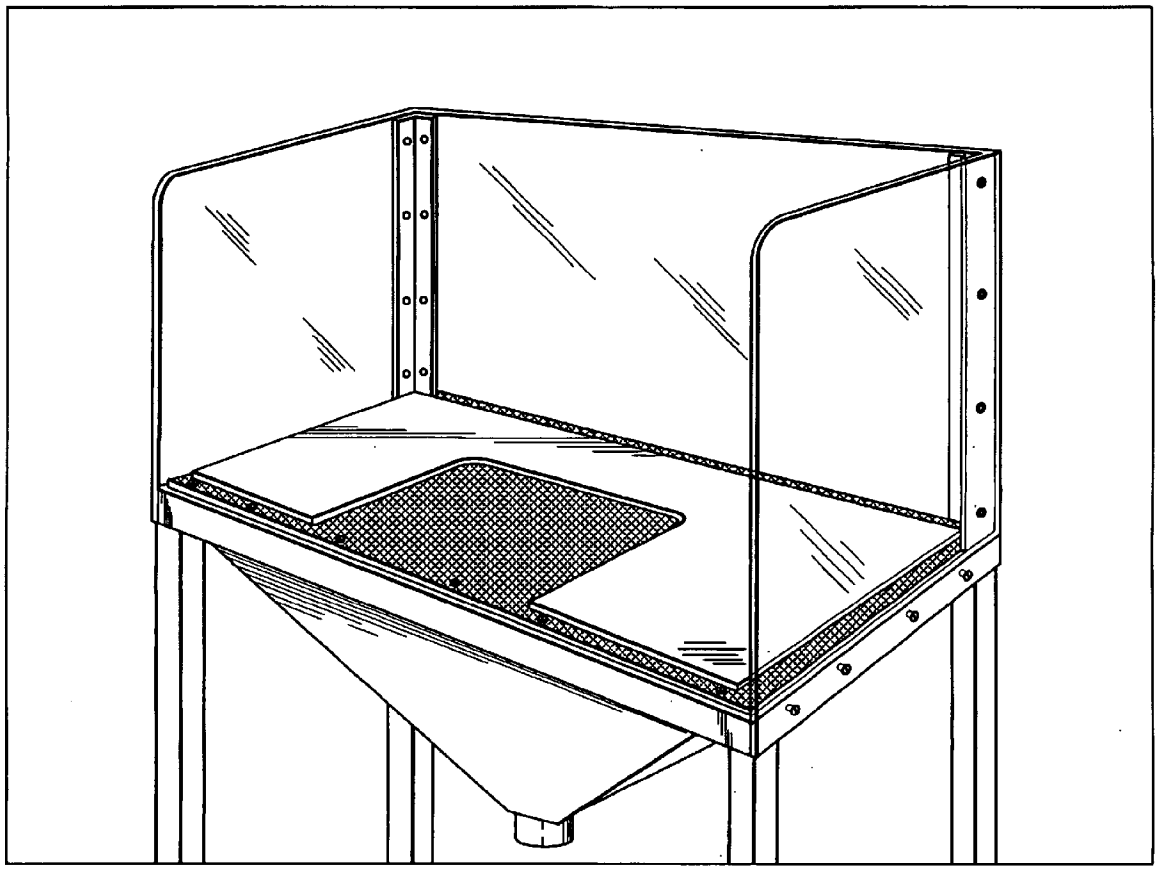
Figure 4A:
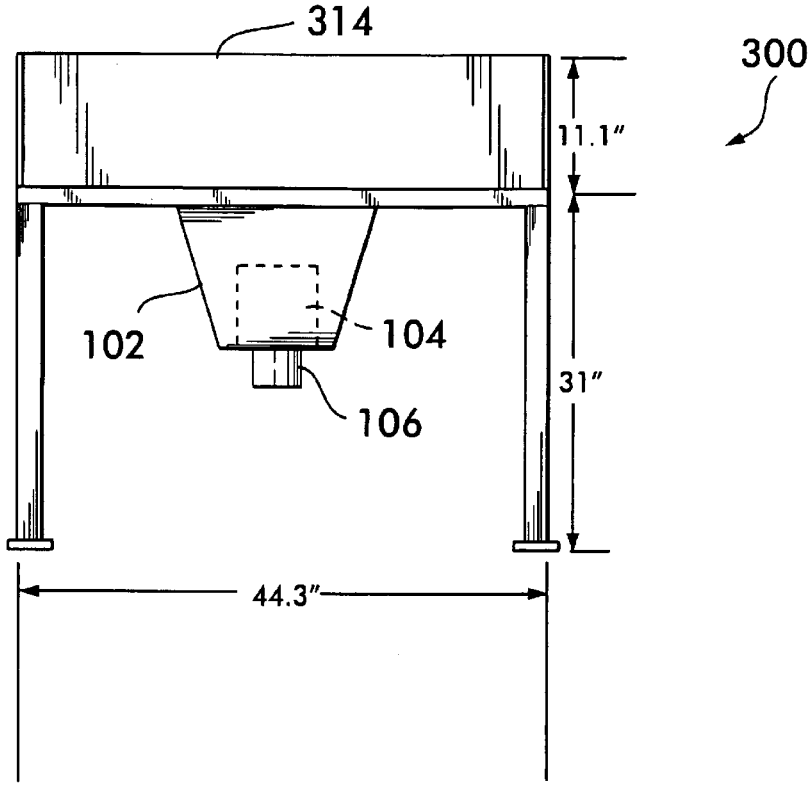
Figure 4B:
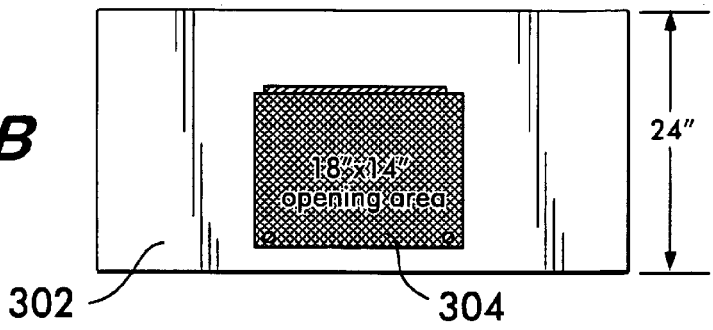
Figure 4C:
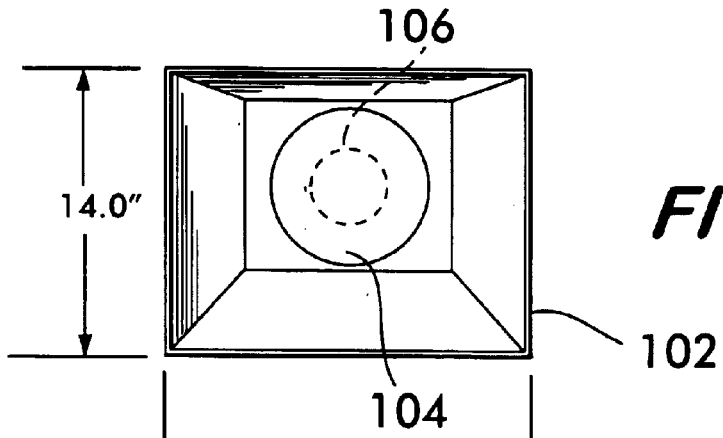
Figure 4D:
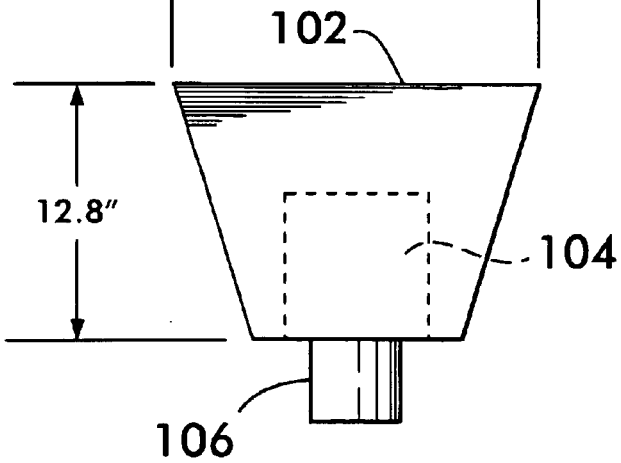
Figure 4E:
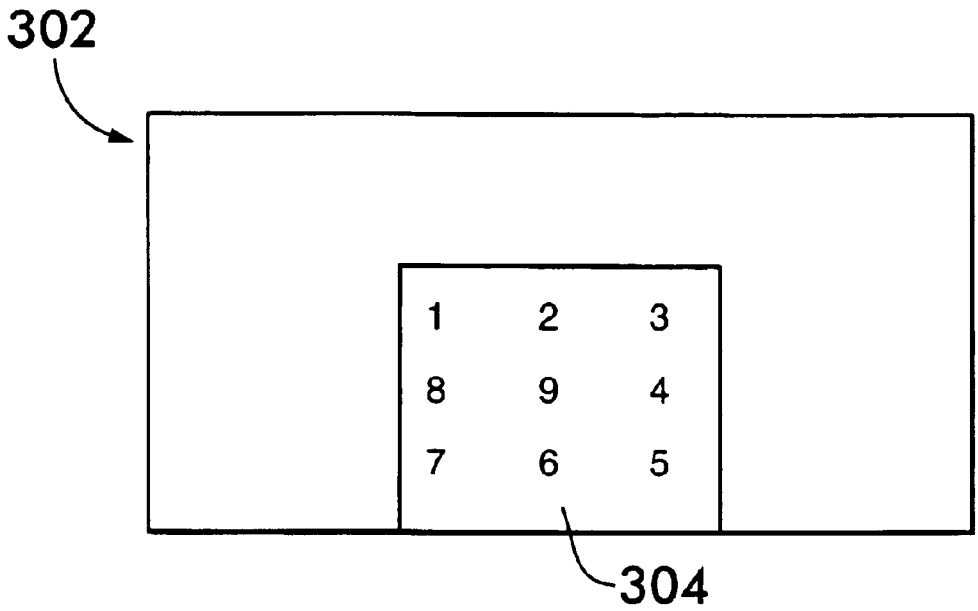
FIG. 4E is a table illustrating the air handling efficiency of the biological hazard mitigation apparatus illustrated in FIGS. 4A-4D.
Figure 5A:
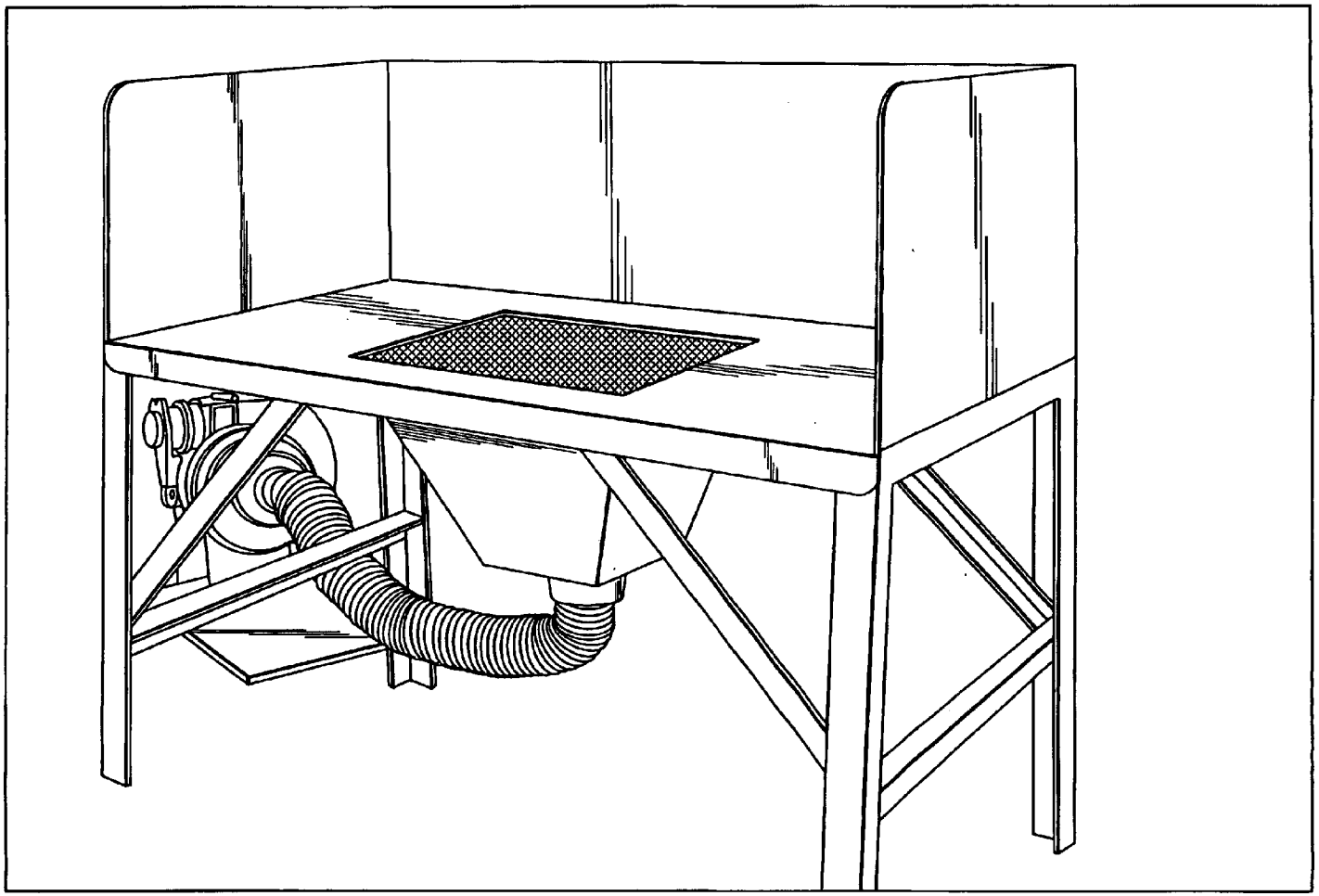
FIGS. 5A, 5B, 5C, 5D, and 5E are photographs of an actual device constructed in accordance with the third preferred embodiment depicted in FIGS. 4A, 4B, 4C, and 4D.
Figure 5B:
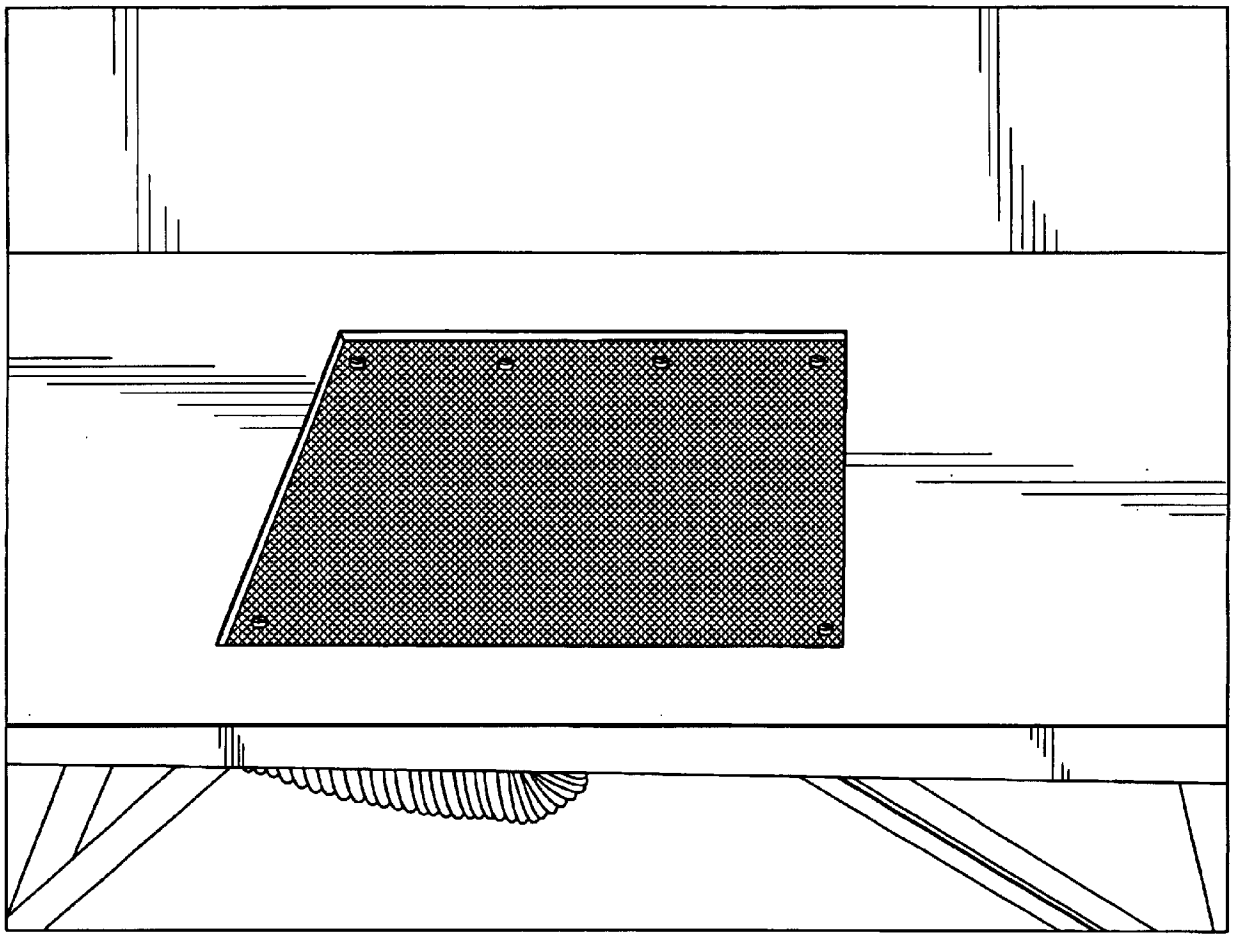
Figure 5C:
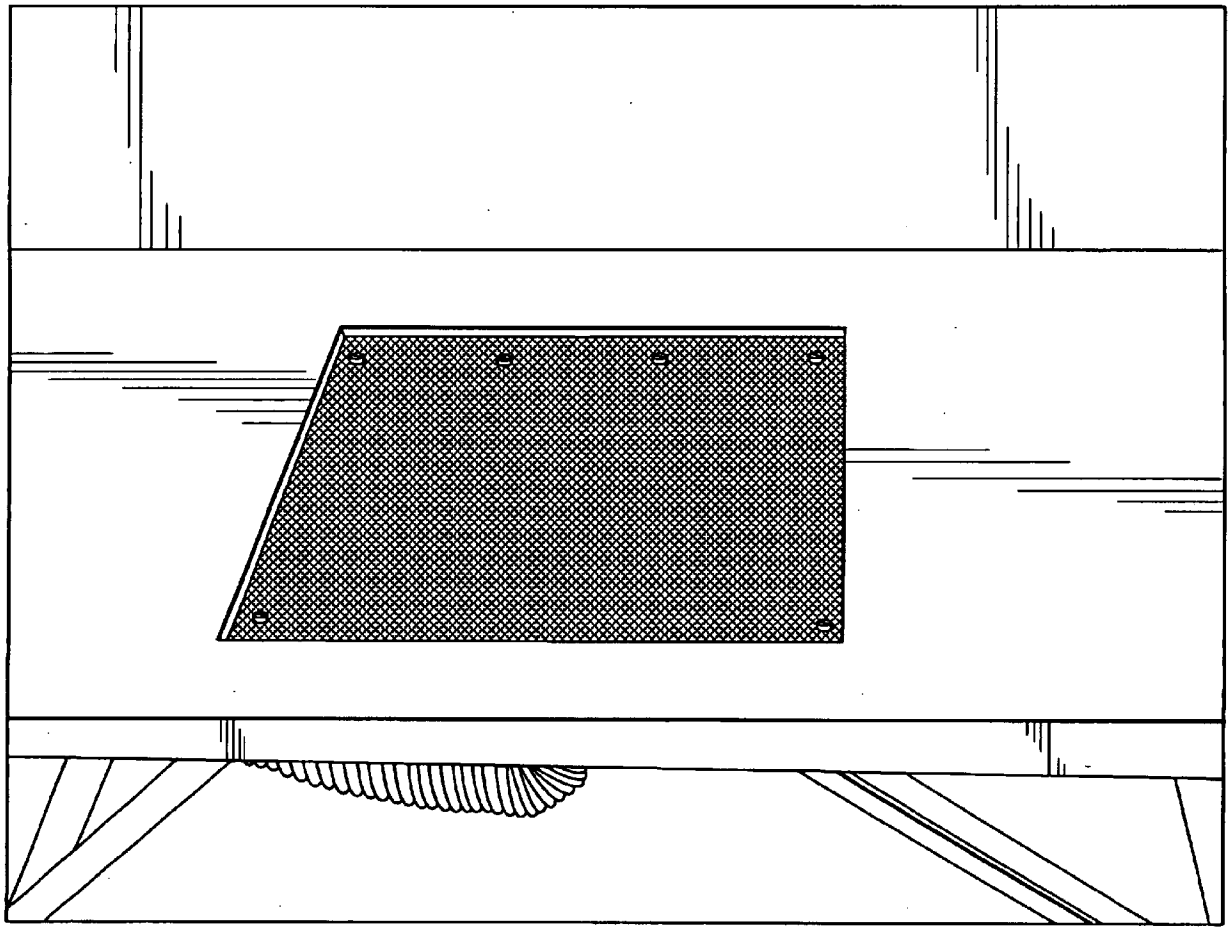
Figure 5D:
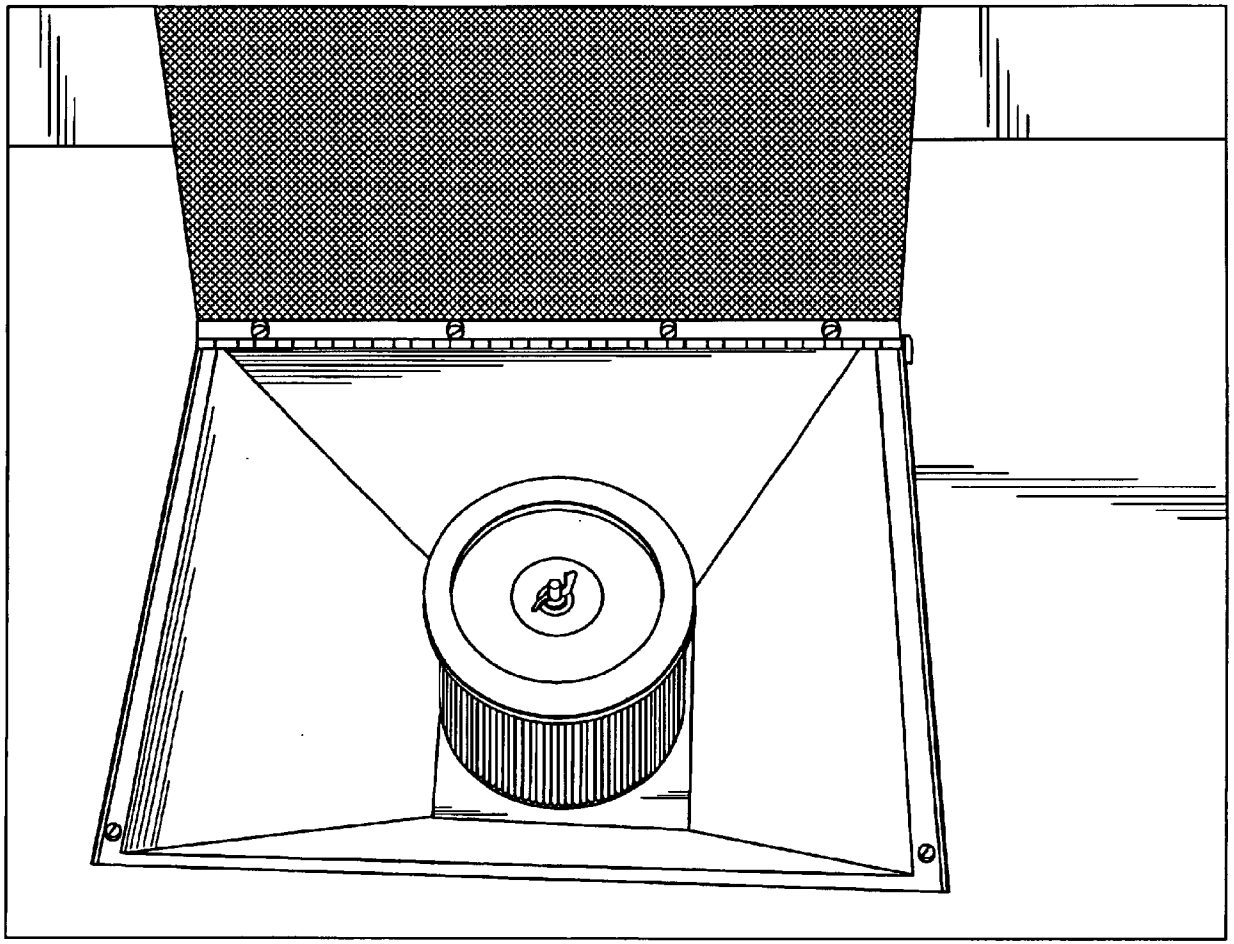
Figure 5E:
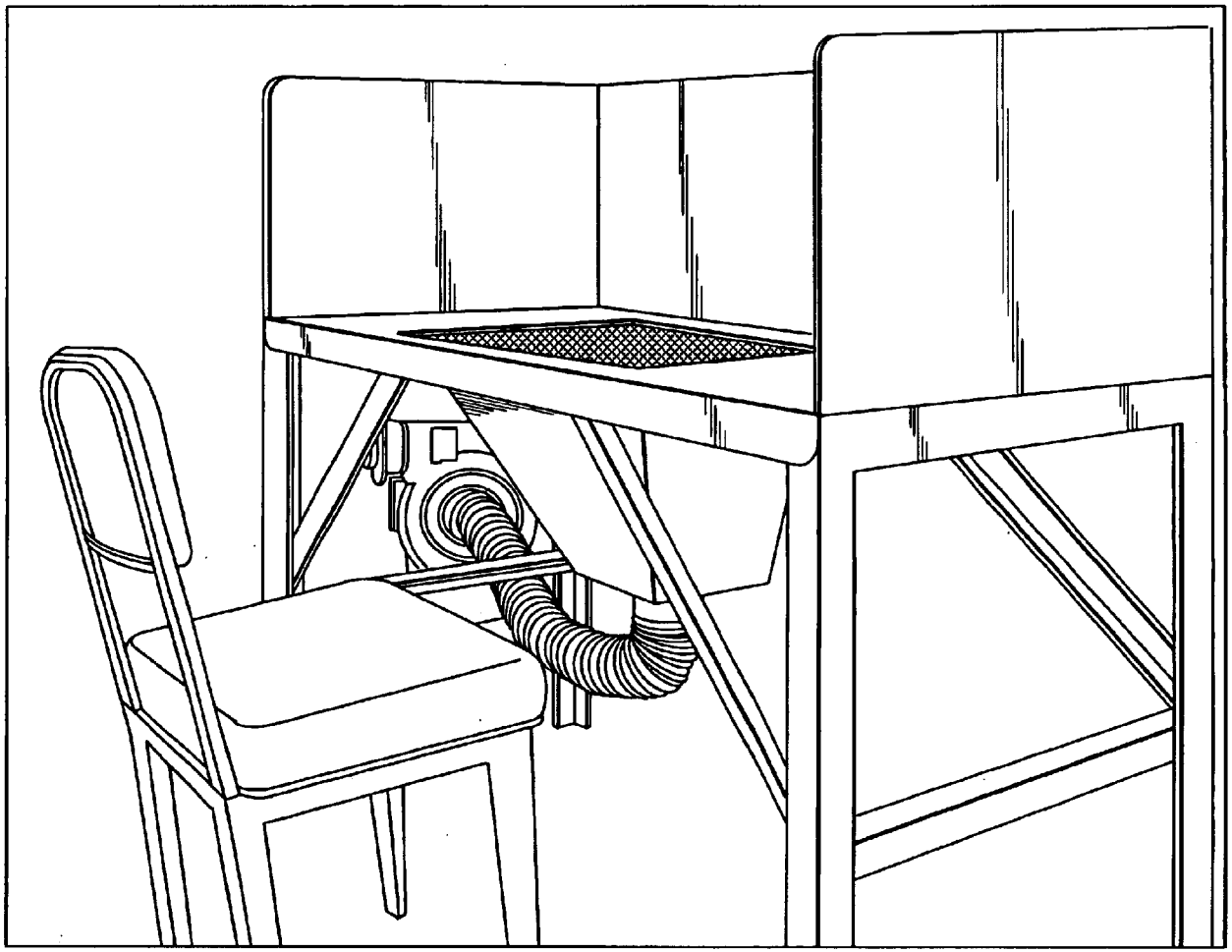

FIG. 1 is a schematic diagram of the major components employed in constructing the biological hazard mitigation apparatus 100 according to the present invention. In FIG. 1, a filter 104 is disposed in a plenum 102, which is pneumatically coupled to a blower, e.g., fan, 110 via one or more ducts 106 and an optional silencer 108. It will be appreciated that these components need not be co-located with one another. As illustrated in FIGS. 3A and 3B, the plenum 102 and filter 104 may be disposed in a closed space while the silencer 108 and blower 110, and associated ducting 106, advantageously can be disposed either in an area which is not frequently occupied or outdoors.

It should be mentioned at this point that placing the filter 104 in the throat of the plenum 102 permits the filter to dampen the sound generated by the other components, most notably, the blower 110. Depending on blower placement, the additional silencer 108 may be omitted.

It should be mentioned that the filter 104 need not be a relatively expensive HEPA filter; the filter need only be selected to efficiently remove particulate in the size of the identified threat. It should also be mentioned that the filter 104 need not be a single filter. The filter advantageously may comprise a roughing filter and a particulate filter, and may also include stages designed to remove fumes or noxious gases. In an exemplary case, the filter 104 advantageously can include an outer bag filter 104*a* in which a pleated paper filter 104*b* is disposed. It will be appreciated that a porous foam filter (not shown) advantageously can be employed in place of the bag filter 104*a*.

Figure 2C:
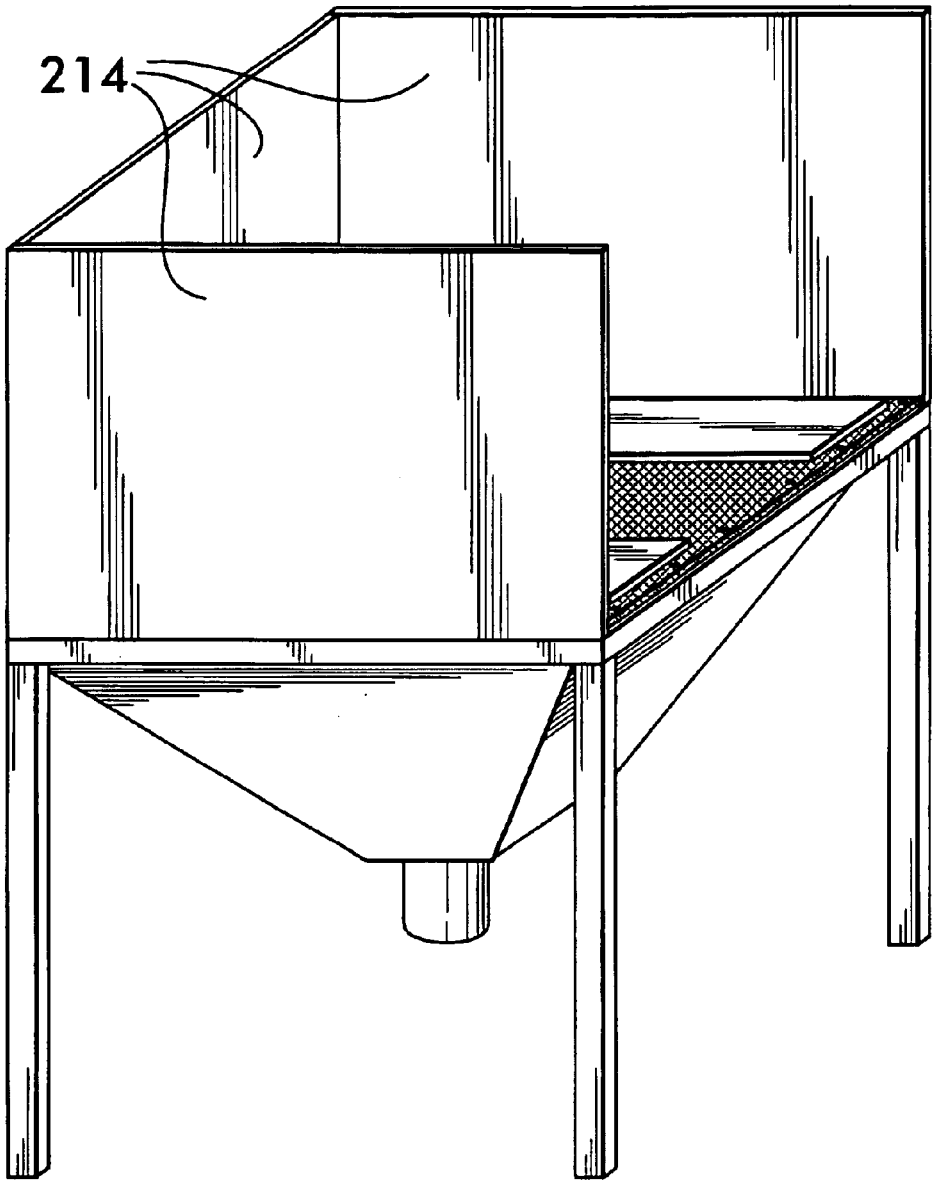

FIGS. 2A-2C illustrate a second preferred embodiment of the biological hazard mitigation apparatus 200 according to the present invention. The apparatus 200 advantageously includes a work surface 202, which is supported by a plurality, e.g., four, legs generally denoted 212. Moreover, a plurality of sidewalls generally denoted 214 restrict access to the work surface 202 so that the work area is substantially inaccessible from the sides or back of the apparatus 200. The plenum 102 and associated filter 104 are suspended from the underside of the work surface 202, preferably adjacent to the work area 204.

Figure 2D:
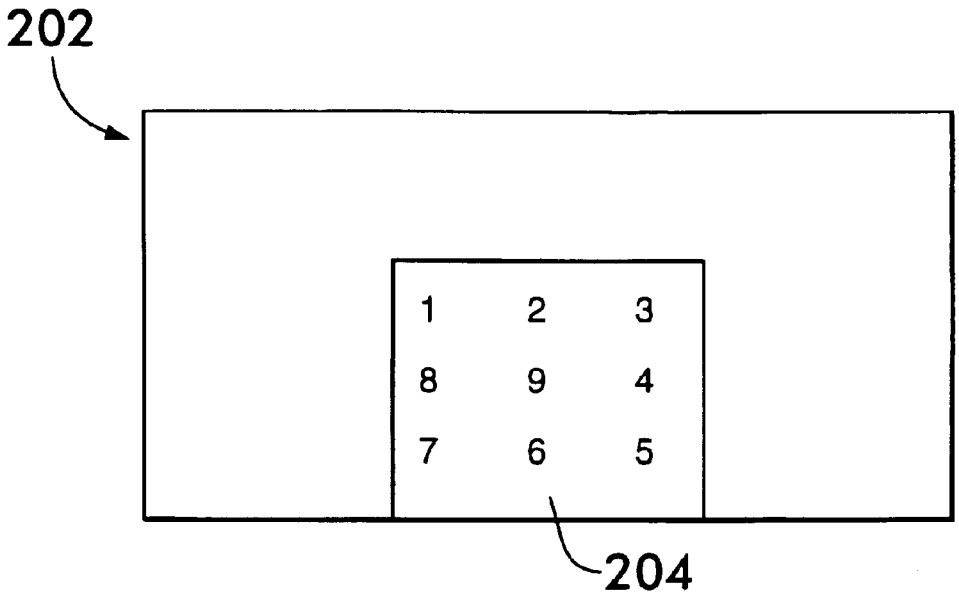
FIG. 2D is a table illustrating the air handling efficiency of the biological hazard mitigation apparatus illustrated in FIGS. 2A-2C.

It should be mentioned that although the work surface 202 could include a myriad of slots, openings, or perforations 206, thereby permitting air to flow from directly above the entire work surface to the plenum 102, this would require that the blower 108 be sized, i.e., increased in size, to insure that a positive differential pressure is maintained to move potentially hazardous materials from the area of the work surface 202 to the filter 104. As shown in FIG. 2D, the work area 204 is a limited portion of the work surface 202. The numbers, i.e., numerals 1, 2, 3, . . . , 9, shown in FIG. 2D, correspond to the measured flowrate at various points on the work area 204. In other words, the work area 204 is limited in area to ensure that the blower 110 provides sufficient head to convey particulate material into the plenum 102 and, ultimately, to the filter 104. The airflow test results for the biological hazard mitigation apparatus illustrated in FIGS. 2A-2C are listed in FIG. 2D. It will be appreciated that increasing the size of the work area would necessitate resizing the blower.

In order to limit airflow from outside the work area 204, the bulk of the work surface 202 advantageously may be free of penetrations 206. Alternatively, the work surface 202 outside of the work area 204 advantageously can be covered with a solid sheet 208 of protective material, e.g., stainless steel, Plexiglas, etc. In the exemplary case illustrated in FIG. 3A, the sheet 208 is Lexan. It will be noted that the sheet 208 facilitates decontamination of the apparatus 200 in the event that decontamination is needed.

It will be noted that the plenum 102 is accessible by personnel from only one side, i.e., the side adjacent to the work area 204 illustrated in FIG. 2B. FIGS. 3A, 3B, 3C, and 3D are photographs of an actual device constructed in accordance with the first preferred embodiment.

Figure 6A:
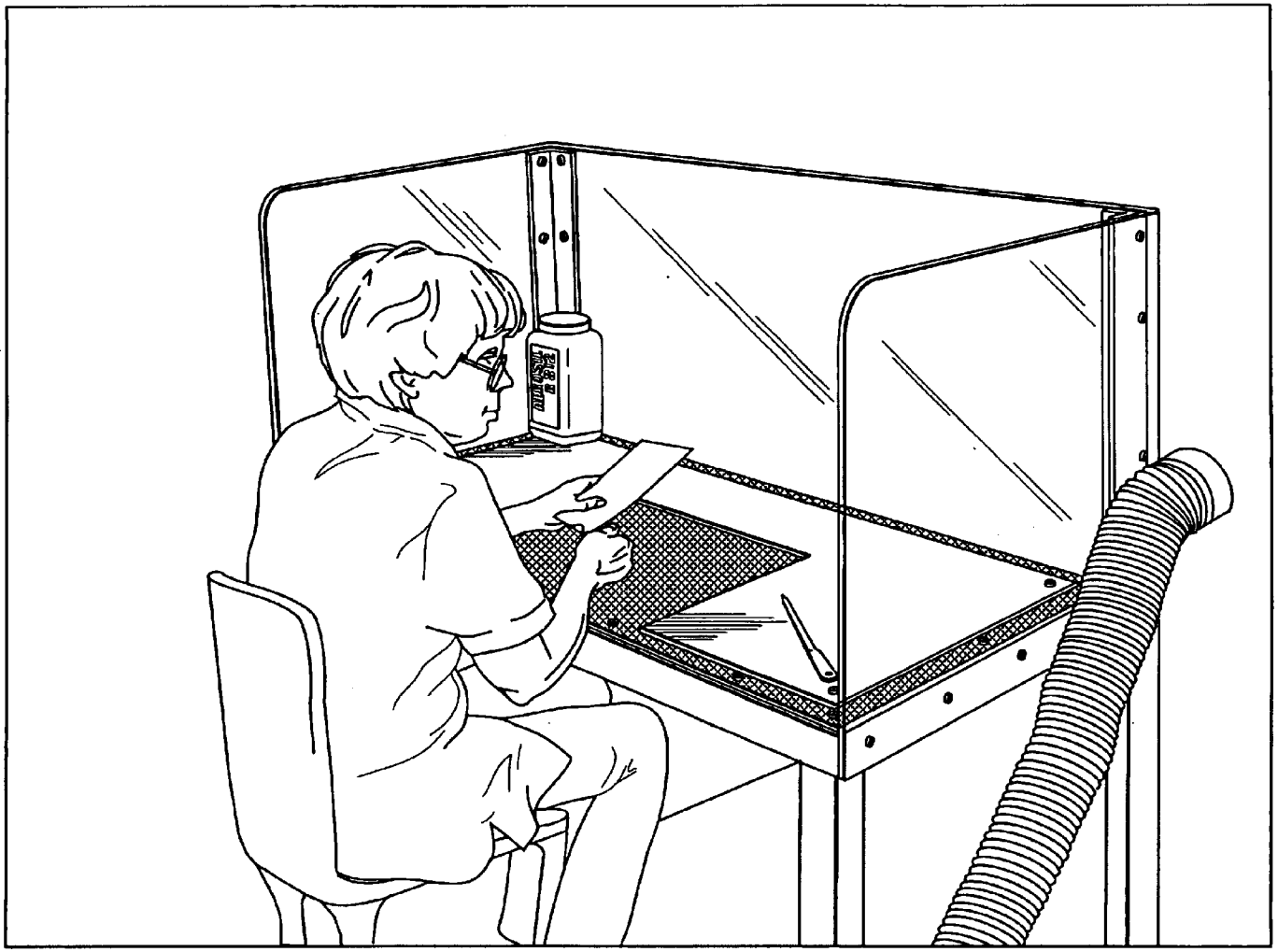
FIGS. 6A and 6B are photographs illustrating the actual operation of the device constructed in accordance with the first preferred embodiment.
Figure 6B:
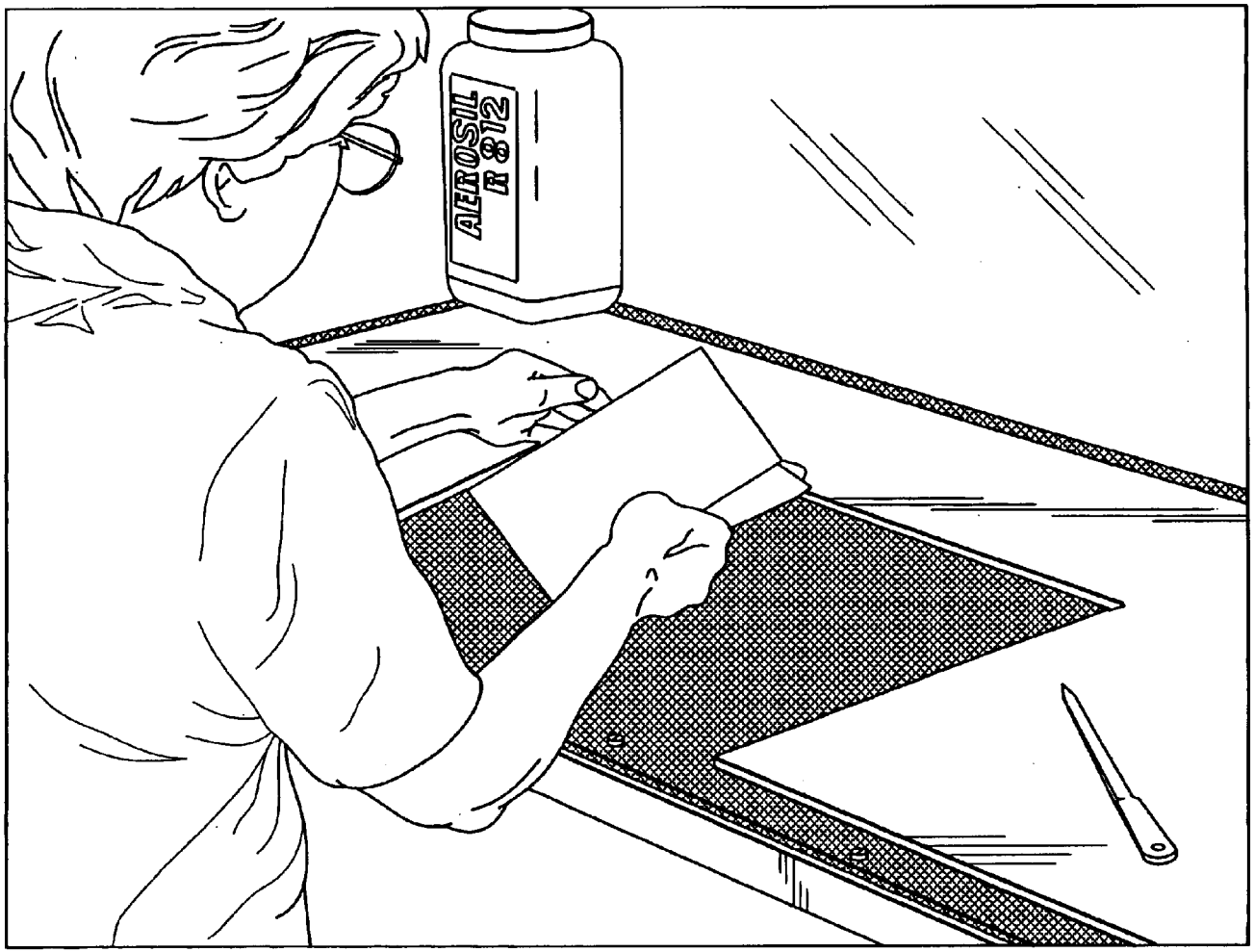
Figure 7A:
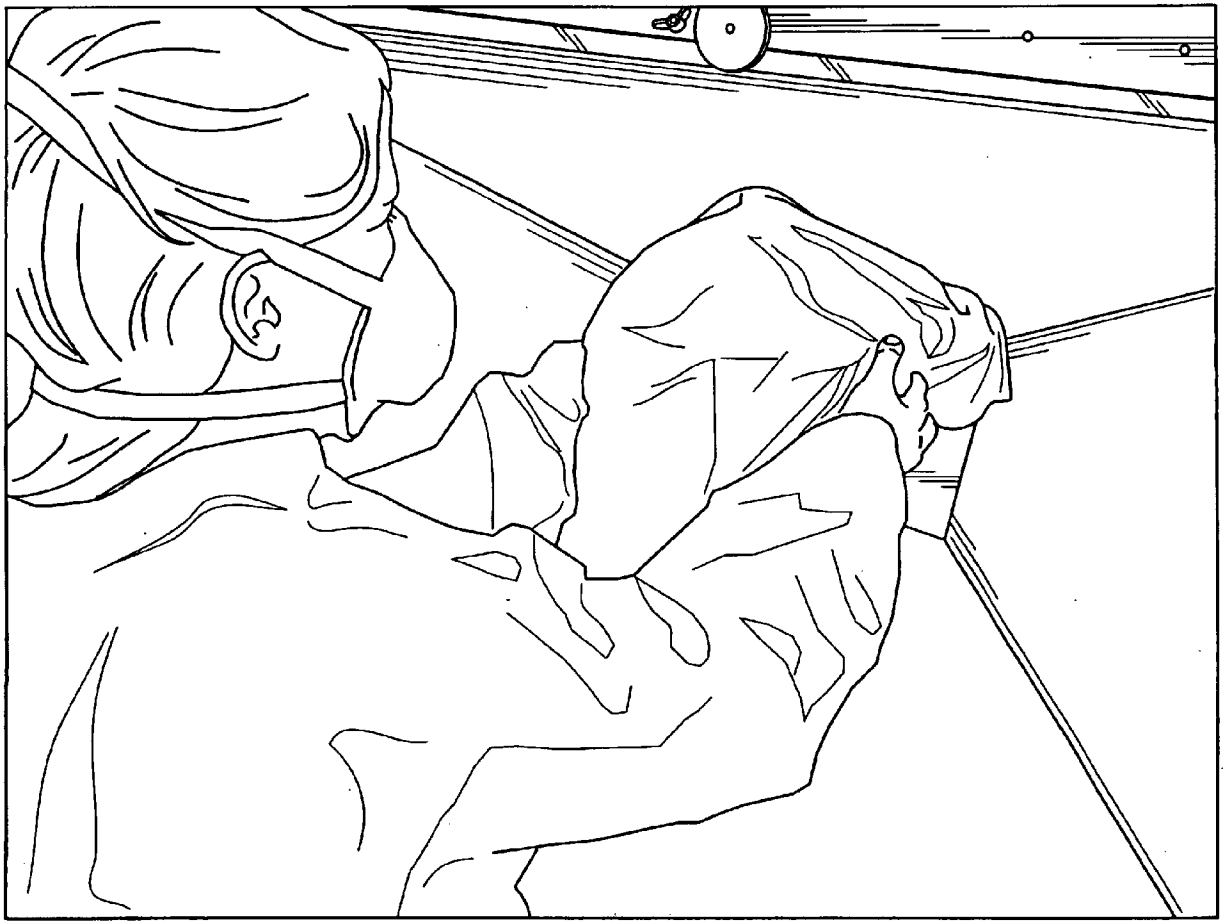
FIGS. 7A and 7B are photographs illustrating filter change out on the actual device constructed in accordance with the first preferred embodiment.
Figure 7B:
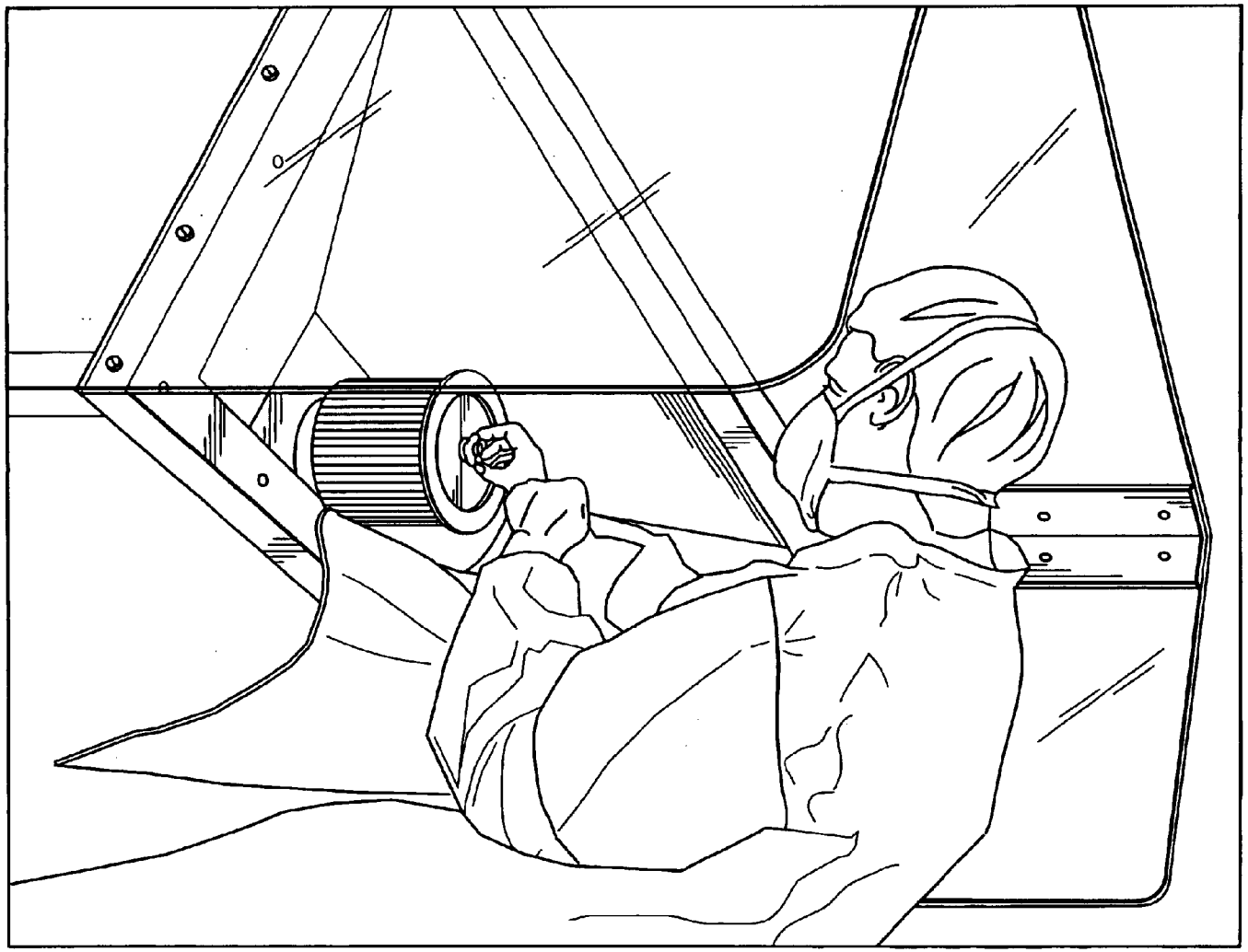

FIGS. 4A, 4B, 4C, and 4D are front and top views, in alternative forms, of a third preferred embodiment of the biological hazard mitigation apparatus 300 according to the present invention. It will be appreciated that while all of the components illustrated in FIGS. 2A-2C are present in the third preferred embodiment illustrated in FIGS. 4A-4D, the third preferred embodiment has been further refined in terms of both personnel comfort and maintainability. For example, in the biological hazard mitigation apparatus illustrated in FIGS. 2A-2C, the size and shape of the plenum 102 prevents the user from sitting in a comfortable position, i.e., a position which could be maintained for several hours. See FIGS. 6A-6B. Moreover, the biological hazard mitigation apparatus 300 illustrated in FIGS. 4A-4D has been optimized with respect to ease of filter replacement. See FIGS. 7A and 7B. Thus, the multiple screws holding the perforated steel work surface 202 over the plenum 102 in FIG. 2B have been replaced by a few, e.g., 2, screws in the biological hazard mitigation apparatus 300 illustrated in FIG. 4B. It will be appreciated that these screws may be replaced by other clamping and fastening devices, such as magnetic clamps.

It should be mentioned that since the numbered elements in FIGS. 4A-4D correspond to like numbered elements in FIGS. 2A-2C, a detailed discussion of elements 302. 304, and 314 will not be provided.

It will also be appreciated that while the plenum size has been reduced between the second and third preferred embodiments, further size reduction is possible. For example, the truncated pyramid plenums employed in the first and second preferred embodiments could be replaced by a frusto-conical plenum. One of ordinary skill in the art will appreciate that this latter arrangement would minimize horizontal surfaces upon which biologically hazardous material could potentially accumulate. FIGS. 5A, 5B, 5C, 5D, and 5E are photographs of an actual device constructed in accordance with the third preferred embodiment.

It will be appreciated that the biological hazard mitigation apparatus according to the present invention advantageously can accommodate a plurality of sensor devices designed to detect one of biological hazards and particulate in suspicious sizes. For example, particles collected by the biological hazard mitigation apparatus would be randomly distributed in size; a spike in the particle size distribution could signal the presence of a biologically hazardous material. Additionally, the sensors of one or more biological detectors advantageously can be disposed in the plenum 102. It should be mentioned that the difference in size between the opening of the plenum and the work area 204 illustrated in FIGS. 2A and 2B permits numerous sensor heads to be located adjacent the air flow without requiring penetrations in the plenum itself, since penetrations in the plenum illustrated in FIGS. 4A and 4B could constitute collection points for biologically hazardous material.

It will be appreciated that FIGS. 2A-2C and 4A-4D provide non-limiting dimensions. The biological hazard mitigation apparatus according to the present invention can be sized to accommodate the normal distribution in mail/package sizes received by any particular facility.

It should also be mentioned that the effectiveness of the biological hazard mitigation apparatus according to the present invention can be enhanced by various mail/packaging methods or protocols. For example, the biological hazard mitigation apparatus can be employed in a time delay manner. In other words, the mail processed on a given day can be set aside while the filter used that day is processed for biological hazards. If the filter employed on Monday is determined to be free from biological hazards on Tuesday, Monday's mail can be safely delivered.

Figure 8:
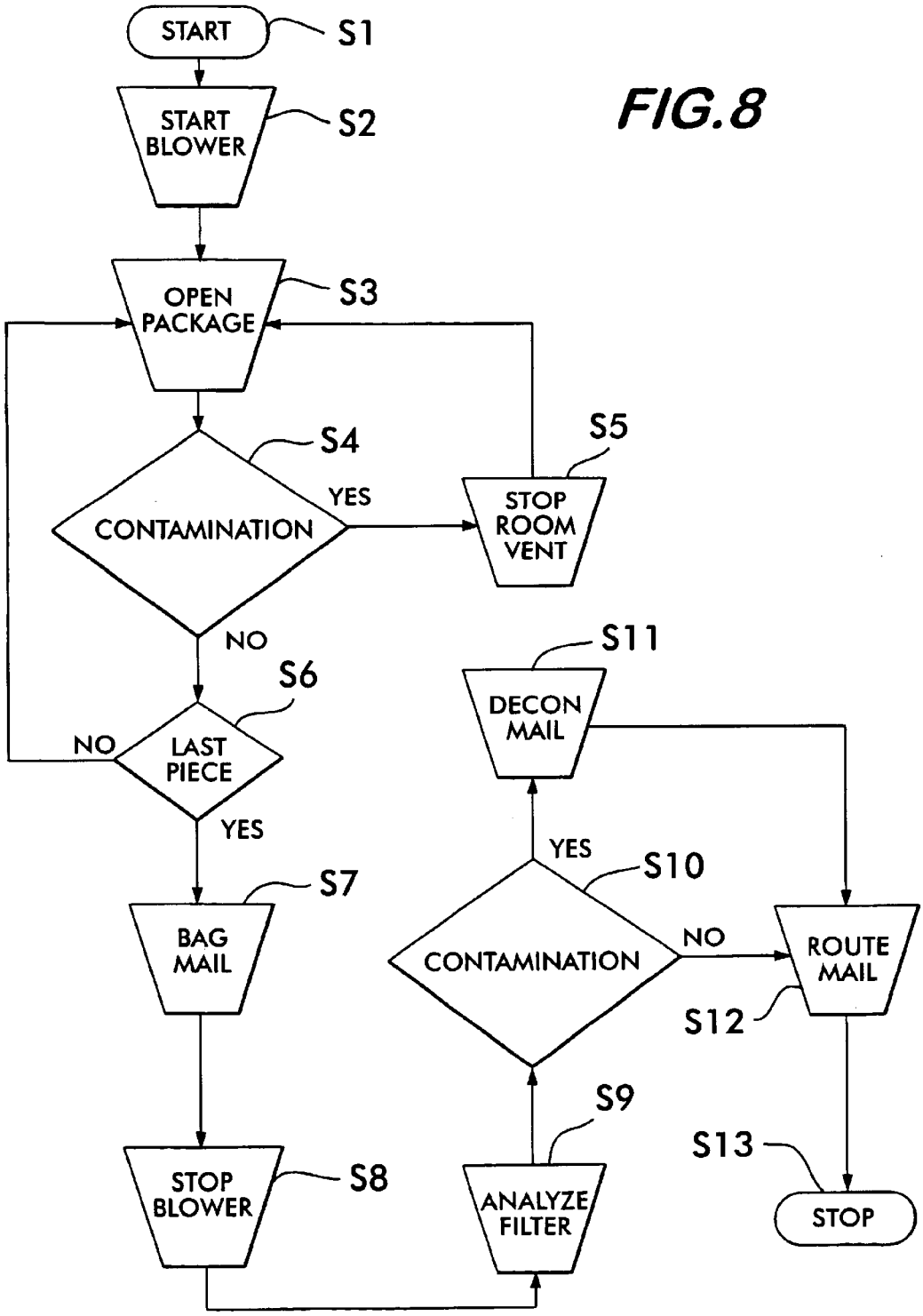
FIG. 8 is a flowchart illustrating the operation of the biological hazard mitigation apparatus according to the various embodiments of the present invention.

FIG. 8 is a flowchart illustrating one exemplar mail handling protocol. It will be appreciated that other mail handling procedures will occur to one of ordinary skill in the art after viewing FIG. 8 and reading the corresponding description of that figure, and all such variations are considered to be within the scope of the present invention.

Referring now to FIG. 8, the mail handling process starts at step S1, wherein mail to be opened is placed next to the biological hazard mitigation apparatus 200 (300), and the area in which the Biological hazard mitigation apparatus is installed is readied for use, biological hazard mitigation apparatus i.e., lights and ventilation turned on, etc. During step S2, the blower 110 is energized. Subsequently, during step S3, a piece of mail (or a package) is selected an opened.

While the operator is extracting the contents from the envelope or package, a visual check is performed for unexpected materials (powders and the like) falling from the packaging during step S4. If visible contamination is present during this check, emergency protocols, e.g., shutting down the ventilation for the room in which the biological hazard mitigation apparatus 200 (300) is installed is carried out during step S5. Then, the operator opens the next envelope or package by repeating step S3 again. It will be appreciated that alternative emergency protocols advantageously can be implemented in the event that potential contamination is observed during step S4, in addition to securing room ventilation (step S5). For example, when potential contamination is identified by the operator, all of steps S7–S13 can be implement immediately, rather than after all of the days mail is unpacked.

Assuming that the answer at step S4 is negative, a further check is performed at step S6 to determine whether all mail has been opened. If the answer is negative, the operation loops back to the start of step S3. If the answer is affirmative, i.e., all envelopes and/or packages have been opened, all mail is packaged, e.g., bagged, for short term storage during step S7 and the blower 110 is stopped during step S8. It will be appreciated that the residue, e.g., opened envelopes, etc., generated by performance of step S3 advantageously can be packaged for further study and/or disposal during step S7.

During step S9, one or more detailed tests for contamination are preformed. For example, the filter 104 advantageously can be tested for biological hazards. In the event that a two stage filter, i.e., a roughing bag filter 104*a* and a polishing pleated paper filter 104*b* are employed as the filter 104, the bag filter 104*a* advantageously can be checked for hazards. It will also be appreciated that the interior of the residue bag can also or additionally be analyzed for biological hazards. It will also be appreciated that analysis of the residue bag will minimize operating costs, since both the residue and the residue bag will be discarded in the event that no contamination is found.

In the event that a biological hazard is identified during step S10, the mail will be decontaminated during step S11 and then routed to recipients during step S12. If no contamination has been identified during step S10, the mail is simply routed as step S12. In either case, the procedure ends at step S13. It goes without saying that when a Biological hazard has been positively identified at step S10, the contamination will be reported to appropriate authorities so that the residue can be further analyzed.

From the discussion above, it will be appreciated that whenever any unknown material is seen to be present on or escaping from received mail/packages, the biological hazard mitigation apparatus provides an effective means for confining the potentially hazardous material in a safe and efficient manner. The user need only shut off normal building ventilation, thereby ensuring that all air in the space is processed by the biological hazard mitigation apparatus. While this air processing would be more efficient if the blower 110 were disposed outdoors, the biological hazard mitigation apparatus advantageously will provide particulate removal even if it exhausts back into the same space occupied by the plenum.

Although presently preferred embodiments of the present invention have been described in detail herein, it should be clearly understood that many variations and/or modifications of the basic inventive concepts herein taught, which may appear to those skilled in the pertinent art, will still fall within the spirit and scope of the present invention, as defined in the appended claims.

What is claimed is:

1. A biological hazard mitigation apparatus for mail processing operations, comprising:

a mail handling work surface having sufficient size to process mail thereon;

a mail handling work area within the work surface;

a plenum pneumatically coupled and proximate to the underside of the work surface, such that the coupled plenum effectively mitigates exposure of biological hazard to personnel conducting mail processing operations;

a filter, disposed in the plenum, effective to trap biological hazards therein; and, a blower pneumatically coupled through ducting to the filter.

2. The biological hazard mitigation apparatus as recited in claim 1, wherein:

the ducting comprises first and second ducts;

the apparatus further comprises a silencer; and the silencer is disposed between the first and second ducts.

3. The biological hazard mitigation apparatus as recited in claim 1, wherein the filter comprises a single filter.

4. The biological hazard mitigation apparatus as recited in claim 1, wherein the filter comprises multiple filters.

5. The biological hazard mitigation apparatus as recited in claim 1, wherein the filter removes noxious gases.

6. The biological hazard mitigation apparatus as recited in claim 1, wherein the filter comprises a HEPA filter.

7. The biological hazard mitigation apparatus as recited in claim 1, further comprising:

a plurality of legs supporting the work surface, the work surface including an upper surface and lower surface, wherein:

the work area comprises a portion of the work surface having air passages therein to permit air flow between the upper surface and the lower surface; and the plenum is operatively coupled to the lower surface of the work surface adjacent to the work area.

8. The biological hazard mitigation apparatus as recited in claim 7, wherein the filter is accessed via the work area.

9. The biological hazard mitigation apparatus as recited in claim 1, wherein the filter and the blower are disposed on opposite sides of a wall.

10. The biological hazard mitigation apparatus as recited in claim 1, wherein an exhaust port of the blower discharges to the environment.

11. A method for operating the biological hazard mitigation apparatus of claim 1, permitting a material handling operation in the vicinity of a work area, comprising the steps of:

processing each piece of received material proximate to the work area to thereby generate processed material;
isolating the processed material;
analyzing the filter for biological hazards;
further processing the processed material when biological hazards are not present; and
decontaminating the processed material when biological hazards are present.

12. The method as recited in claim 11, wherein:

the apparatus comprises a filter effective for capturing anthrax spores.

13. The method as recited in claim 11, wherein:

the filter comprises a HEPA filter; and the analyzing is performed on the upstream surface of the HEPA filter.

14. A method for handing mail comprising the steps of:

providing the biological hazard mitigation apparatus of claim 1; and, processing the mail proximate to the work area of the biological hazard mitigation apparatus for identification of the presence of biological contaminants within the mail.

15. The method as recited in claim 14, wherein:

the step of processing includes visual inspection of the mail.

16. The method as recited in claim 14, wherein:

the step of processing includes packaging the mail.

17. The biological hazard mitigation apparatus as recited in claim 1, wherein adjacent surfaces of the filter and the plenum are substantially equal in surface area.

18. The method as recited in claim 14, wherein the step of processing includes testing for biological hazards.

19. The method as recited in claim 18, wherein the testing for biological hazards includes biological testing of the filter.

20. A processed mail product produced by the method of claim 14.

* * * * *